US010787914B2

(12) United States Patent
Abbott et al.

(10) Patent No.: US 10,787,914 B2
(45) Date of Patent: Sep. 29, 2020

(54) CMC AIRFOIL WITH MONOLITHIC CERAMIC CORE

(71) Applicant: United Technologies Corporation, Hartford, CT (US)

(72) Inventors: Michael G. Abbott, Jupiter, FL (US); Michael G. McCaffrey, Windsor, CT (US); Grant O. Cook, III, Spring, TX (US)

(73) Assignee: United Technologies Corporation, Farmington, CT (US)

( * ) Notice: Subject to any disclaimer, the term of this patent is extended or adjusted under 35 U.S.C. 154(b) by 661 days.

(21) Appl. No.: 14/912,317

(22) PCT Filed: Aug. 19, 2014

(86) PCT No.: PCT/US2014/051666
§ 371 (c)(1),
(2) Date: Feb. 16, 2016

(87) PCT Pub. No.: WO2015/031106
PCT Pub. Date: Mar. 5, 2015

(65) Prior Publication Data

US 2016/0201479 A1 Jul. 14, 2016

Related U.S. Application Data

(60) Provisional application No. 61/871,700, filed on Aug. 29, 2013.

(51) Int. Cl.

| | |
|---|---|
| ***F01D 5/28*** | (2006.01) |
| ***F01D 5/14*** | (2006.01) |
| *F01D 5/18* | (2006.01) |

(52) U.S. Cl.
CPC ..... *F01D 5/284* (2013.01); *F01D 5/282* (2013.01); *F01D 5/14* (2013.01); *F01D 5/187* (2013.01);
(Continued)

(58) Field of Classification Search
CPC ..... F01D 5/14; F01D 5/147
See application file for complete search history.

(56) References Cited

U.S. PATENT DOCUMENTS 5,234,152 A * 8/1993 Glaeser ..... B23K 20/023 228/121
5,372,298 A * 12/1994 Glaeser ..... B23K 20/023 228/121
(Continued)

FOREIGN PATENT DOCUMENTS

JP 2000517397 A 12/2000
JP 2011196179 A 10/2011

OTHER PUBLICATIONS

Grant O. Cook III—Carl D. Sorensen, "Overview of transient liquid phase and partial transient liquid phase bonding", J Mater Sci (2011) 46:5305-5323.
(Continued)

*Primary Examiner* — Kenneth J Hansen
*Assistant Examiner* — Brian O Peters
(74) *Attorney, Agent, or Firm* — Kinney & Lange, P.A.

(57) ABSTRACT

An airfoil includes a core having a first surface, a skin having a second surface disposed over at least a portion of the first surface of the core, and at least one of a transient liquid phase (TLP) bond and a partial transient liquid phase (PTLP) bond. The bond(s) are disposed between the first surface and the second surface, joining the skin to the core.

22 Claims, 6 Drawing Sheets

(52) U.S. Cl.
CPC ..... *F05D 2220/32* (2013.01); *F05D 2230/23* (2013.01); *F05D 2300/6033* (2013.01)

(56) References Cited

U.S. PATENT DOCUMENTS

| | | | | |
|---|---|---|---|---|
| 5,626,462 | A | 5/1997 | Jackson et al. | |
| 6,609,894 | B2 * | 8/2003 | Jackson et al. | B23P 6/005 29/889.1 |
| 6,733,907 | B2 | 5/2004 | Morrison et al. | |
| 7,258,530 | B2 * | 8/2007 | Morrison | F01D 5/147 29/889.71 |
| 7,481,621 | B2 * | 1/2009 | Campbell | F01D 5/08 415/115 |
| 7,565,996 | B2 * | 7/2009 | Das | B23K 20/02 228/246 |
| 7,695,580 | B2 * | 4/2010 | Cutler | C04B 35/01 156/89.11 |
| 7,837,438 | B2 | 11/2010 | Campbell | |
| 8,137,611 | B2 | 3/2012 | Merrill et al. | |
| 8,197,211 | B1 | 6/2012 | Liang | |
| 8,251,652 | B2 * | 8/2012 | Campbell | F01D 5/189 415/209.3 |
| 8,317,474 | B1 | 11/2012 | Liang | |
| 8,349,111 | B2 | 1/2013 | Akash et al. | |
| 8,366,392 | B1 | 2/2013 | Liang | |
| 9,073,787 | B2 * | 7/2015 | Joseph | C04B 37/006 |
| 2004/0043204 | A1 | 3/2004 | Nair et al. | |
| 2004/0154725 | A1 | 8/2004 | Mako et al. | |
| 2008/0035707 | A1 * | 2/2008 | Glaeser | C04B 37/006 228/121 |
| 2008/0199661 | A1 * | 8/2008 | Keller | B32B 18/00 428/188 |
| 2008/0298975 | A1 | 12/2008 | James et al. | |
| 2010/0032875 | A1 | 2/2010 | Merrill et al. | |
| 2011/0192024 | A1 | 8/2011 | Allen | |
| 2011/0229337 | A1 * | 9/2011 | Carper | B32B 18/00 416/241 B |

OTHER PUBLICATIONS

International Search Report and Written Opinion from PCT Application Serial No. PCT/US2014/051666, dated Nov. 24, 2014, 8 pages.

Extended European Search Report for EP Application No. 14840150.8, dated Mar. 31, 2017, 9 pages.

* cited by examiner

CMC AIRFOIL WITH MONOLITHIC CERAMIC CORE

BACKGROUND

The disclosed subject matter relates generally to nonmetallic airfoils and more particularly to ceramic airfoils.

Laminated ceramic matrix composite (CMC) airfoils are well known for gas turbine engines, but have certain shortcomings Though extremely light in weight and exhibiting tolerance of foreign object damage (FOD), they are expensive to process into complex aerodynamic shapes. Conversely, ceramic airfoils are easier to form than laminated CMC airfoils, but are prone to large scale fracture due to FOD.

Attempts have been made to produce a reliable hybrid ceramic/CMC airfoil. However, it is difficult to combine a CMC shell with a ceramic spar due to limited ways of joining the two materials. Further, when using traditional CMC processing steps, large portions of the CMC have to contact the ceramic spar in order to accurately form the airfoil surfaces. This leaves little or no room for spaces or passages between the spar and shell, for example, to provide cooling air to the spar without sacrificing the smoothness of the CMC airfoil surface. It also requires the ceramic of the spar and the ceramic matrix of the shell to have closely matched chemical, mechanical, and thermal properties at elevated temperatures to avoid damaging chemical reactions and/or residual stress.

SUMMARY

An airfoil comprises a core having a first surface, a skin having a second surface disposed over at least a portion of the first surface of the core, and at least one of a transient liquid phase (TLP) bond and a partial transient liquid phase (PTLP) bond. The at least one bond is disposed between the first surface and the second surface, joining the skin to the core.

A method for making a hybrid airfoil component comprises providing a ceramic airfoil core. A ceramic matrix composite (CMC) airfoil skin is placed over at least a portion of the ceramic airfoil core. The CMC skin is joined to the ceramic core to define an airfoil shape. The joining step is performed at least in part by forming a partial transient liquid phase (PTLP) bond between the ceramic core and the CMC skin.

DETAILED DESCRIPTION

Figure 1:
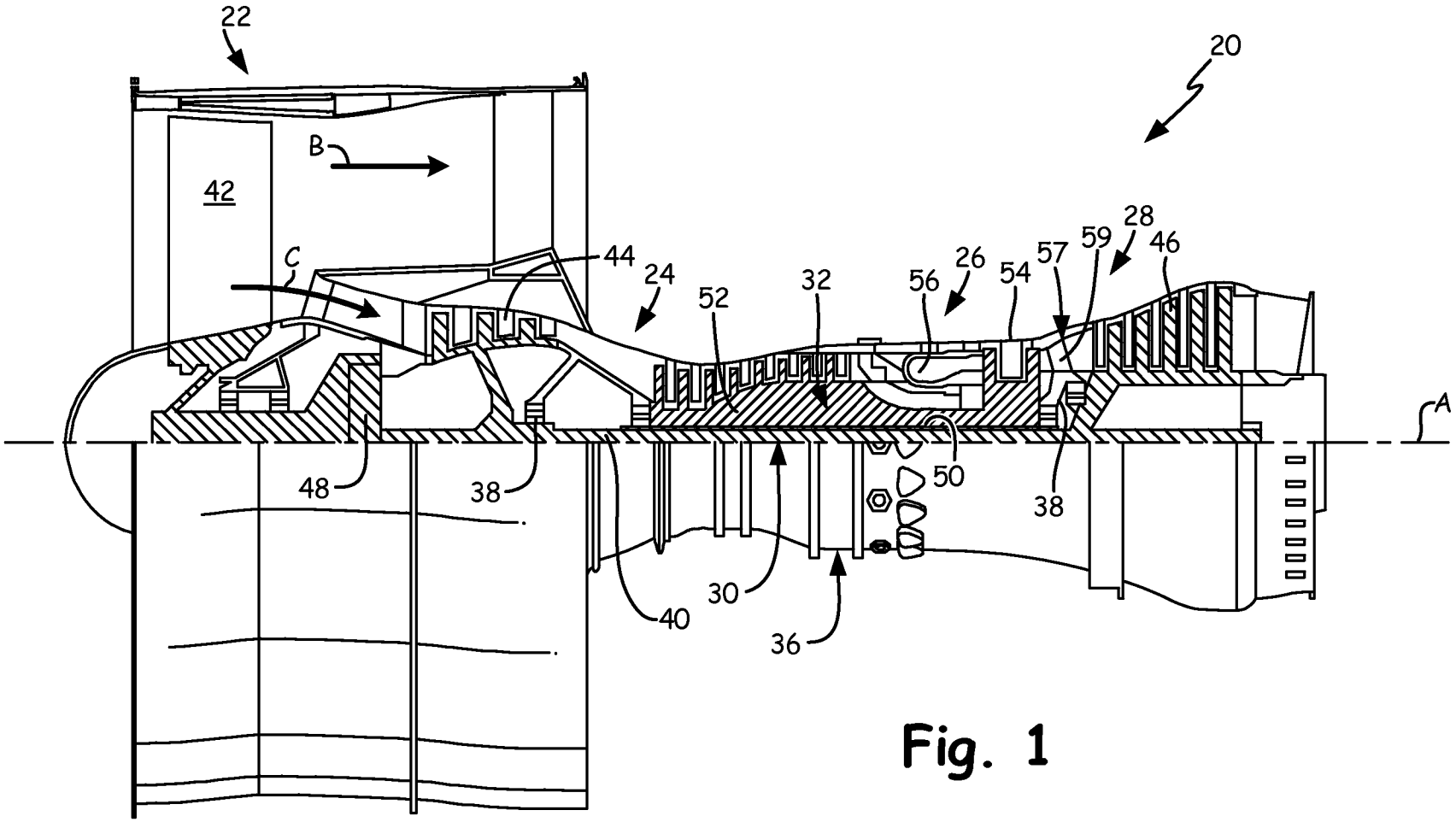
FIG. 1 shows a gas turbine engine.

FIG. 1 is a schematic view of gas turbine engine 20. Gas turbine engine 20 is disclosed herein as a two-spool turbofan that generally incorporates fan section 22, compressor section 24, combustor section 26 and turbine section 28, although alternative gas turbine designs (including designs utilizing a power turbine in place of fan section 22) may also benefit from the described subject matter. In turbofan embodiments, fan section 22 drives air along bypass flowpath B, while the compressor section 24 drives air along a core flowpath for compression and communication into the combustor section 26, and then expansion through the turbine section 28.

Dual-spool embodiments such as example engine 20 generally include low-speed spool 30 and high-speed spool 32 mounted for rotation about an engine central longitudinal axis A. Spools 30, 32 rotate relative to engine static structure 36 via several bearing systems 38. It should be understood that different numbers of spools, as well as various bearing systems 38 may alternatively or additionally be provided.

Low-speed spool 30 generally includes inner shaft 40 that interconnects a fan 42, low-pressure compressor 44 and low-pressure turbine 46. In certain turbofan embodiments, inner shaft 40 can be connected to fan 42 through geared architecture 48 to drive fan 42 at a lower speed than low-speed spool 30. High-speed spool 32 includes outer shaft 50 that interconnects high-pressure compressor 52 and high-pressure turbine 54. Combustor 56 is arranged between high-pressure compressor 52 and high-pressure turbine 54. Mid-turbine frame 57 of the engine static structure 36 can be arranged axially between high-pressure turbine 54 and low-pressure turbine 46. Mid-turbine frame 57 can further support bearing systems 38 in turbine section 28. Inner shaft 40 and outer shaft 50 are concentric and rotate via bearing systems 38 about the engine central longitudinal axis A which is collinear with their longitudinal axes.

The core airflow is compressed by low-pressure compressor 44 and then by high-pressure compressor 52, mixed and burned with fuel in combustor 56, then expanded over high-pressure turbine 54 and low-pressure turbine 46. Combustor 56 is therefore in fluid communication with the compressor section, to receive air compressed by low-pressure compressor 44 and high-pressure compressor 52. Mid-turbine frame 57 can also include airfoils 59 which are in the core airflow path. Turbines 46 and 54 are in fluid communication with combustor 56, wherein the expanding gas provided by combustor 56 drives the respective low-speed spool 30 and high-speed spool 32.

Figure 2:
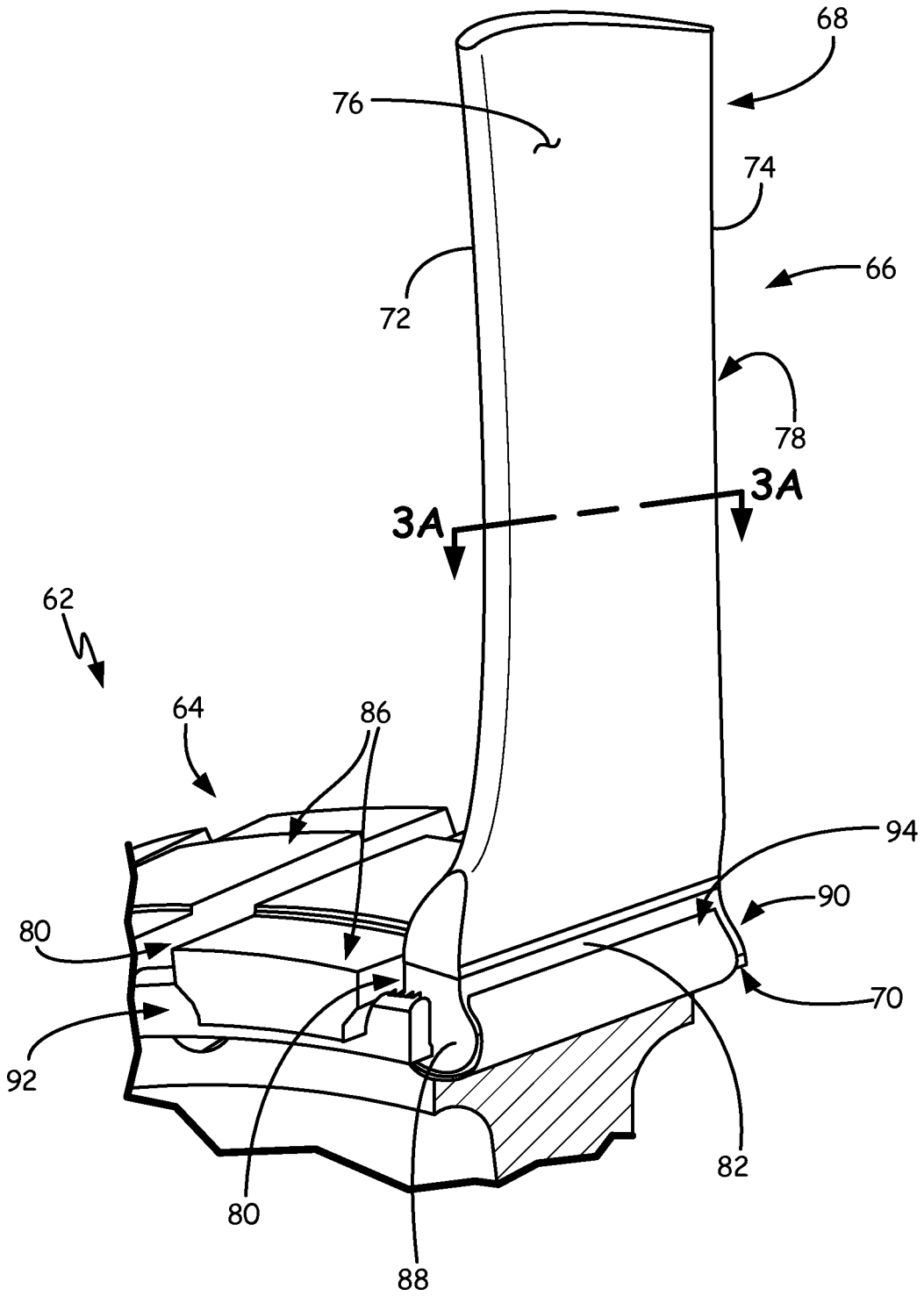
FIG. 2 is a portion of a rotor disk and a hybrid ceramic/CMC airfoil.

FIG. 2 shows a portion of gas turbine rotor assembly 62, which includes rotor disk 64 with a plurality of circumferentially distributed hybrid rotor blades 66 (one shown in FIG. 2). Hybrid rotor blade 66 includes airfoil section 68, root section 70, leading edge 72, trailing edge 74, pressure surface 76, suction surface 78, radial retention slots 80, pressure-side root bearing surface 82, disk bearing surfaces 84, disk teeth 86, forward bearing surface 88, aft bearing surface 90, retention ring 92, and shim 94.

Certain embodiments of rotor assembly 62 and/or hybrid rotor blade 66 are disposed in the hot section, such as high-pressure turbine 54, or low-pressure turbine 46 as shown in FIG. 1. Additionally or alternatively, rotor assembly 62 may be disposed in fan section 22, low-pressure compressor section 44, and/or high-pressure compressor section 50. In other alternative embodiments, hybrid airfoil sections can be formed in a similar manner for one or more stator assemblies in these sections of engine 20.

In FIG. 2, airfoil section 68 can include leading edge 72, trailing edge 74, pressure surface 76, and suction surface 78. Root section 70 can be a single root with circumferentially opposed bearing surfaces for securing hybrid blade 66 into a corresponding radial retention slot 80 of disk 64. Alternatively, root section 70 can be a multilobe root. In FIG. 2, pressure-side root bearing surface 82 and an opposing suction-side bearing surface (not visible) mate with respective bearing surfaces 84 of disk teeth 86, which define a longitudinal extent of slot 80. Root section 70 includes longitudinally facing forward bearing surface 88 and aft bearing surface 90 (not visible in FIG. 2). At least one of these longitudinally facing bearing surfaces can be secured using one or more retention rings 92, or alternatively using another bearing surface of the disk (not shown). Shim 94 can be disposed annularly between blade root section 70 and the corresponding radial retention slot 80.

It will be recognized that certain embodiments of rotor assembly 62 can include an inner-diameter flow surface defined, for example, by a plurality of circumferentially distributed blade platforms. Such platforms may be integrally formed or secured to each hybrid blade 66 proximate the transition between airfoil section 68 and root section 70. Likewise, certain embodiments may also include an outer-diameter flow surface that may be integrally formed or secured to each hybrid blade 66 proximate the outer tip of the airfoil. However, to better illustrate other elements, any possible inner or outer flow surface or blade platform has been omitted from the examples described herein.

Figure 3A:
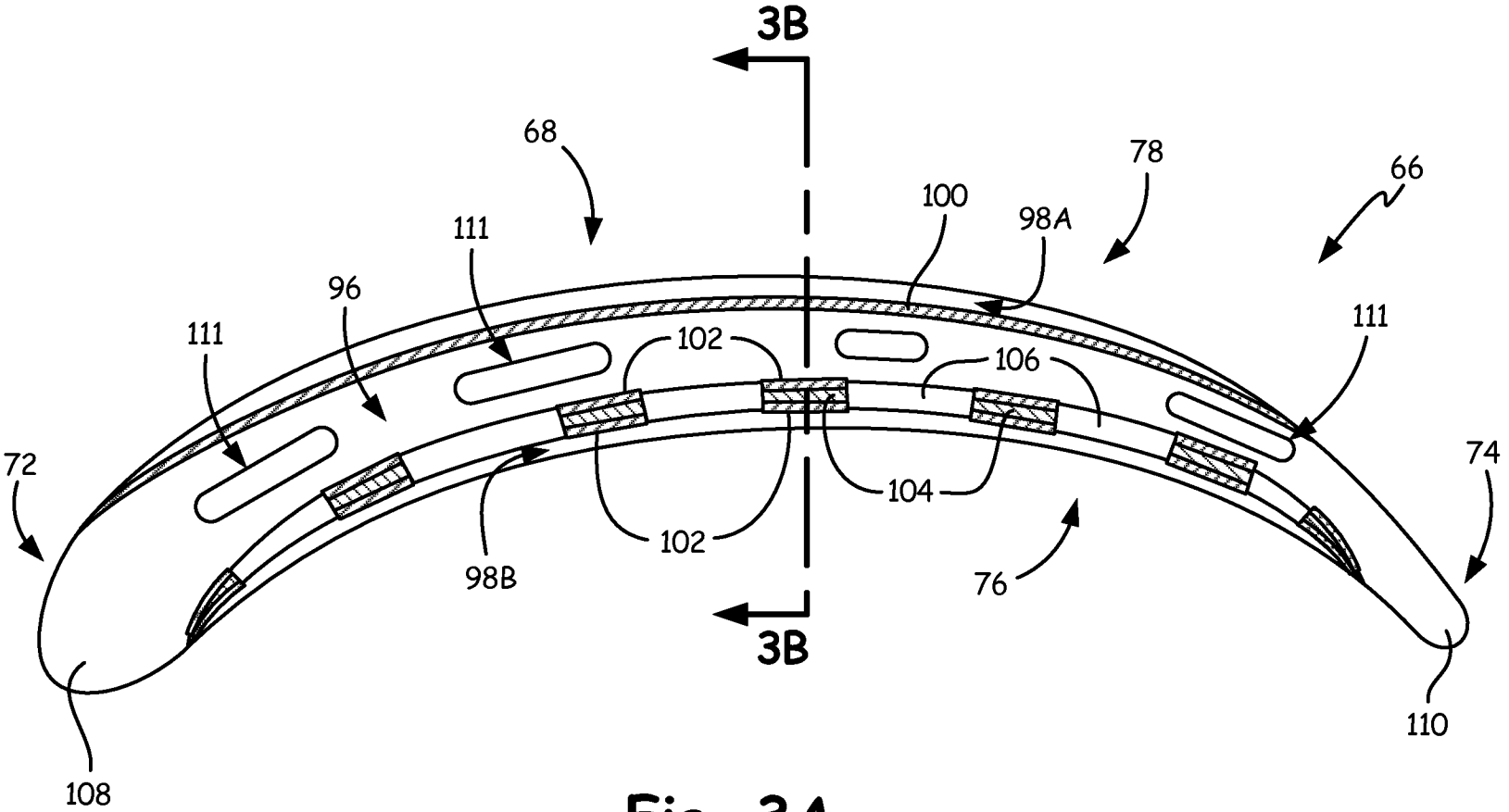
FIG. 3A is a first sectional view taken across line 3A-3A of the airfoil shown in FIG. 2.
Figure 3B:
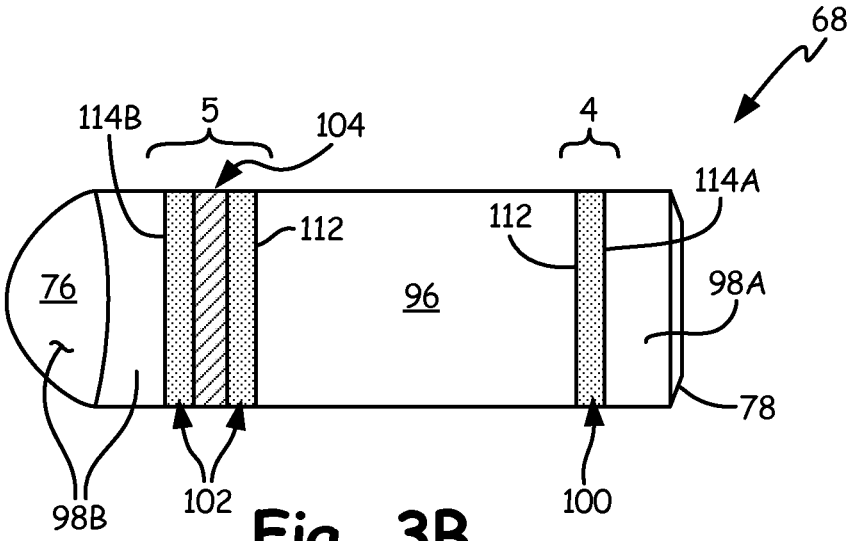
FIG. 3B is a second sectional view of the airfoil taken across line 3B-3B of FIG. 3A.

As shown in more detail in FIGS. 3A and 3B, hybrid blade 66 can include a hybrid airfoil section 68 in which a core with a first (e.g., ceramic) outer surface is bonded to a second (e.g., ceramic matrix composite/CMC) inner surface of an airfoil skin. The skin can be disposed over at least a portion of the outer surface of the ceramic core to define one or more airfoil surfaces such as pressure surface 76 and/or suction surface 78. At least one of a transient liquid phase (TLP) bond and a partial transient liquid phase (PTLP) bond can be disposed between the first outer surface and second inner surface, thereby joining the CMC skin to the ceramic core to define a shape of airfoil section 68. Due to reduced weight and moment of inertia, as well as the ability to form complex shapes, airfoil section 68 can be highly tapered to increase engine efficiency.

FIG. 3A is a first sectional view taken across line 3A-3A of the airfoil shown in FIG. 2. FIG. 3B is a sectional view taken across line 3B-3B of FIG. 3A, showing an example construction of hybrid blade 66 in more detail.

As seen in FIG. 3A, airfoil section 68 of hybrid blade 66 generally includes ceramic core 96, CMC skin portions 98A, 98B, and PTLP bonds 100, 102. Suction-side CMC skin portion 98A is joined to ceramic core 96 by one or more suction-side PTLP bonds 100. Pressure-side CMC skin portion 98B can be generally spaced from ceramic core 96 except proximate a location of one or more pressure-side PTLP bonds 102 and thermal protection structures 104. This defines one or more thermal protection spaces 106 between thermal protection structures 104 and ceramic core 96 to reduce thermal conduction from hot gases impinging on pressure-side CMC skin portion 98B. For example, the hot gases can be working gases when airfoil 68 is used in hot section and/or power turbine applications. Thermal protection spaces 106 can also serve as cooling passages and can be placed in communication with any cooling passages (not shown) which may be formed through ceramic core 96. Thermal protection structures 104 and PTLP bond(s) 102 allow for greater differential thermal expansion between core 96 and CMC skin portion 98B. Thus the respective ceramic materials in core 96 and CMC skin portions 98A, 98B can be selected with less concern of damage that can be caused by differential thermal growth.

The inner surface of the CMC skin can extend over some or all of the outer surface of the ceramic core. In the example shown, the CMC skin does not extend over the entirety of airfoil section 68. As shown in FIG. 3A, ceramic core 96 has leading-edge portion 108 defining airfoil leading edge 72, as well as trailing-edge portion 110 defining airfoil trailing edge 74. This configuration is shown in part because it allows for simple incorporation of CMC sheets to define substantial portions of pressure surface 76 and suction surface 78. This configuration allows for CMC skin portions 98A, 98B to hold together ceramic core 96 in the event of failure (e.g., from a foreign object strike) while simplifying manufacture of the outer CMC surfaces and incorporation of the same into airfoil section 68. However, it will be appreciated that a substantially contiguous CMC skin can also extend over some or all of leading edge 72 and trailing edge 74, as well as the airfoil tip.

A hybrid blade also provides increased FOD resistance, especially in larger airfoils. Instead of potential perforation of a CMC blade, or failure of a ceramic blade, the energy absorption characteristics of ceramic core 96 and CMC skin portions 98A, 98B often will keep airfoil section 68 intact for a more graceful failure, which can prevent cascading foreign object damage to the engine. In any of these embodiments, the hybrid configuration also offers increased flexibility in the complexity of small details and complex shapes with monolithic ceramics relative to a CMC structure. Spaces 106 can also double as skin cooling passages depending on the configuration of thermal protection structures 104.

Ceramic core 96 can be a monolithic ceramic, i.e., not reinforced by internal fibers or the like. However, core 96 can include cooling passages 111 formed during or after casting. In certain embodiments, ceramic core 96 includes at least one ceramic compound selected from one of: aluminum oxide ($Al_2O_3$), silicon nitride ($Si_3N_4$), silicon carbide (SiC), tungsten carbide (WC), and zirconium oxide ($ZrO_2$).

Suction- and pressure-side CMC skin portions 98A, 98B can be individually or integrally formed from a plurality of fibers disposed in a ceramic matrix. Example fibers can include combinations of silicon carbide (SiC), titanium carbide (TiC), aluminum oxide ($Al_2O_3$), and/or carbon (C). The ceramic matrix can be made, for example, from aluminum oxide ($Al_2O_3$), silicon nitride ($Si_3N_4$), and silicon carbide (SiC), or other suitable ceramic materials.

FIG. 3B shows additional details of airfoil section 68. Respective inner surfaces 114A, 114B of suction-side CMC skin portion 98A and pressure-side CMC skin portion 98B can be bonded to outer surface(s) 112 of ceramic core 96 by way of corresponding suction- and pressure-side PTLP bonds 100, 102. Suction-side CMC skin portion 98A can be secured directly to an outer surface of ceramic core 96 via contiguous suction-side PTLP bond 100, while pressure-side CMC skin portion 98B can be secured indirectly to ceramic core 96 via a plurality of individual pressure-side PTLP bonds 102.

PTLP bonds 100, 102 can include an alloyed interlayer having a melting temperature higher than a melting temperature of constituent elements defining the alloyed interlayer. The melting temperature is also higher than the bonding temperature. This results in high-temperature interlayer links between ceramic core 96 and CMC skin portions 98A, 98B which are more resilient and require less bonding area than a sintered connection between the ceramics. It also allows for the use of different ceramics and tailoring of mechanical and thermal properties of materials for core 96 and CMC skin portions 98A, 98B with much less concern for differential thermal expansion.

Figure 4A:
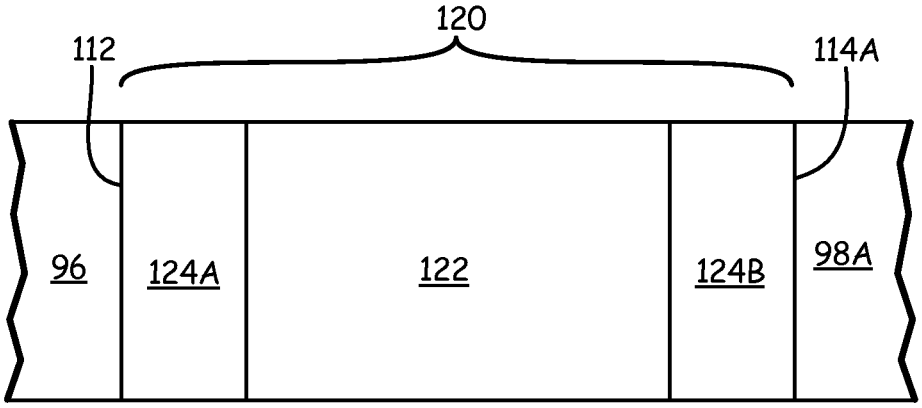
FIG. 4A shows a first PTLP bond joining the suction side CMC skin to the adjacent ceramic core.
Figure 4B:
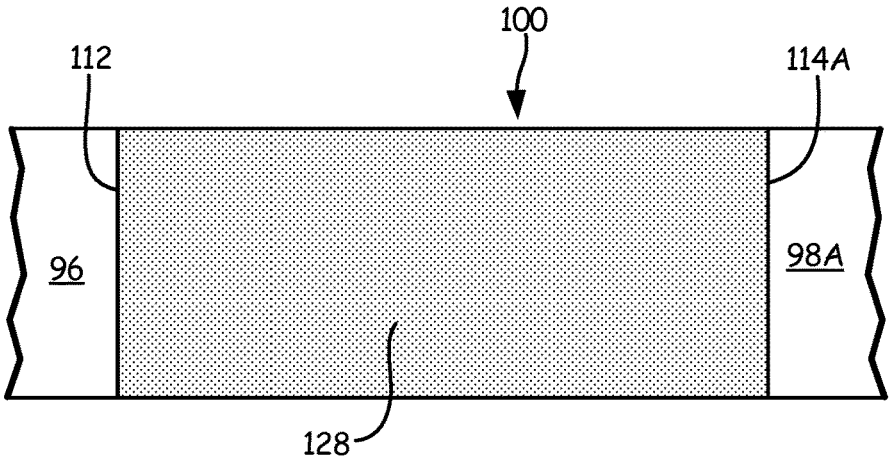
FIG. 4B shows an example configuration setting up the first PTLP bond shown in FIG. 4A.

FIGS. 4A and 4B show formation of PTLP bond 100 directly between inner surface 114A of suction-side CMC skin portion 98A and outer surface 112 of ceramic core 96. A PTLP bond is one which has several similarities to brazed and diffusion-bonded connections, but which is formed at lower bonding temperatures than brazing and lower bonding pressures than diffusion bonding. Properly designed PTLP bonds can reduce intermaterial stresses and provide controlled diffusion between the different material interfaces. The lower temperatures of PTLP bond formation also mitigate potential microstructural weakening associated with other joining techniques. The resulting bond strength of alloyed interlayer 128 can be comparable to that of brazed, sintered, or diffusion-bonded connections and substantially maintains the structural integrity and composition of the substrates.

FIG. 4A shows a precursor to PTLP bond 100, PTLP bond assembly 120, which includes refractory segment 122, core-side foil layer 124A, and skin-side foil layer 124B. Foil layers 124A, 124B are shown as individual layers but one or both can alternatively comprise multiple foil layers. Refractory segment 122 can be, for example, nickel or an alloy thereof. Alternative refractory metals suitable for refractory segment 122 include gold, cobalt, copper, niobium, palladium, platinum, silicon, tantalum, titanium, vanadium, and alloys thereof. Foils 124A, 124B are selected so as to wet the ceramic substrate (here, ceramic core 96 and the ceramic matrix of CMC skin 98A) at the bonding temperature.

As foil layers 124A, 124B are melted, thereby wetting the adjacent ceramic (i.e., core outer surface 112 and CMC skin inner surface 114A), bond assembly 120 can then be maintained at a bonding temperature for a suitable time so as to homogenize the materials into PTLP bond 100 shown in FIG. 4B with alloyed interlayer 128.

Figure 5A:
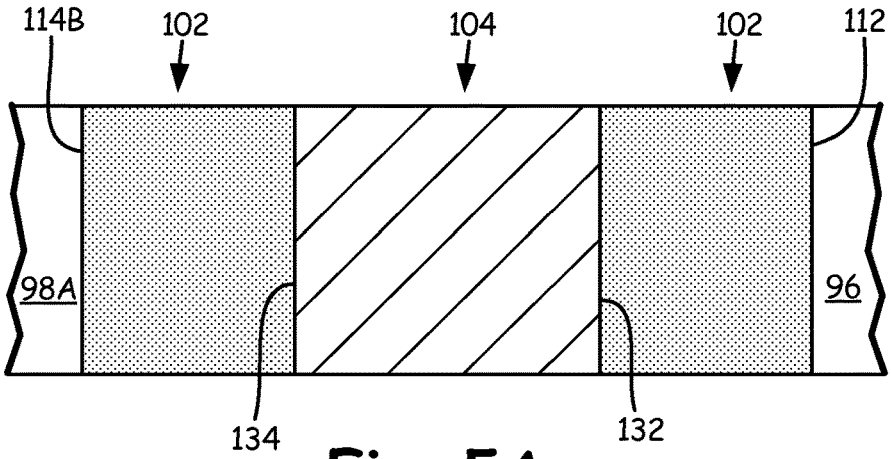
FIG. 5A depicts a first alternate configuration of an airfoil with PTLP bonds on either side of a thermal protection structure, which together join the CMC skin and the ceramic core.

FIG. 5A shows a configuration of PTLP bonding which incorporates thermal protection structure 104. Thermal protection structure 104, along with at least one PTLP bond 102, is disposed between inner surface 114B of pressure-side CMC skin portion 98B and outer surface 112 of ceramic core 96.

The configuration shown in FIG. 5A differs from FIGS. 4A and 4B in that a thermal protection structure is disposed across space 106 (shown in FIG. 3B) between surfaces 112, 114B. One can take advantage of PTLP bonding to create a resilient high-melting-temperature and substantially uniform bond between two similar or dissimilar materials. With the configuration of FIG. 5A, one can potentially utilize a third ceramic material for thermal protection structure 104. The third material can be similar to the ceramic of one or both substrates. Alternatively, thermal protection structure 104 can be formed from a more thermally insulating ceramic relative to one or both ceramics of core 96 and CMC skin 98B.

It can be seen that each of the plurality of thermal protection structures 104 (one shown in FIG. 5A) each have core side 132 and skin side 134 joined to a corresponding one of CMC skin inner surface 114B and ceramic core outer surface 112. Thermal protection structure 104 is shown here as an individual structure with both core side 132 and skin side 134 each joined to a corresponding one of ceramic core 96 and CMC skin 98B by partial transient liquid phase (PTLP) bonds 102.

PTLP bonds 102 can each be formed in a manner similar to that shown in FIG. 4A, in which refractory segment 122 is sandwiched between at least one foil layer on either side to form a bond assembly 120. Bond assemblies 120 are then heated to form PTLP bonds which have a higher melting temperature than the bonding temperature. This increased melting temperature is a result of isothermal solidification of alloyed interlayer 128 which mitigates the concern of remelting the bond.

Returning to FIG. 5A, thermal protection structure 104 is shown as a separate structure bonded on either side to each substrate (core 96 and CMC skin 98B). This is but one illustrative example configuration. It will also be appreciated that one or more portions of thermal protection structure 104 can be integrally formed into one or both of ceramic core 96 or skin 98B. In one example, thermal protection structure 104 is integrally formed to ceramic core 96, eliminating the need for one of PTLP bonds 102.

Figure 5B:
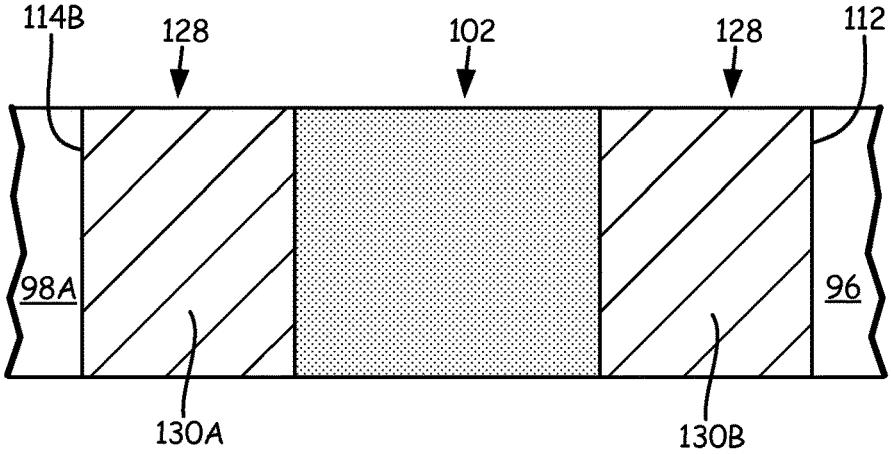
FIG. 5B is a second alternate configuration of an airfoil with a PTLP bond between two thermal protection elements forming a thermal protection structure joining the CMC skin and the ceramic core.

In another example, shown in FIG. 5B, interlocking or alternating thermal protection structures 104 can be formed on surfaces 112, 114B. FIG. 5B shows a first thermal protection element 130A and a second element 130B joined by PTLP bond 132 to form alternate thermal protection structure 128. A combination of such elements could also allow for appropriate mistake proofing by ensuring that the proper elements 130A, 130B line up for each thermal protection structure 128.

Thermal protection structures 104, 128 (shown respectively in FIGS. 5A and 5B) can have any suitable cross-sectional geometry. In these examples, thermal protection structures 104, 128 can be an array of round or square projections. These and other example geometries are shown in commonly assigned U.S. patent application Ser. No. entitled: "Method For Joining Dissimilar Engine Components", filed on an even date herewith.

Figure 6:
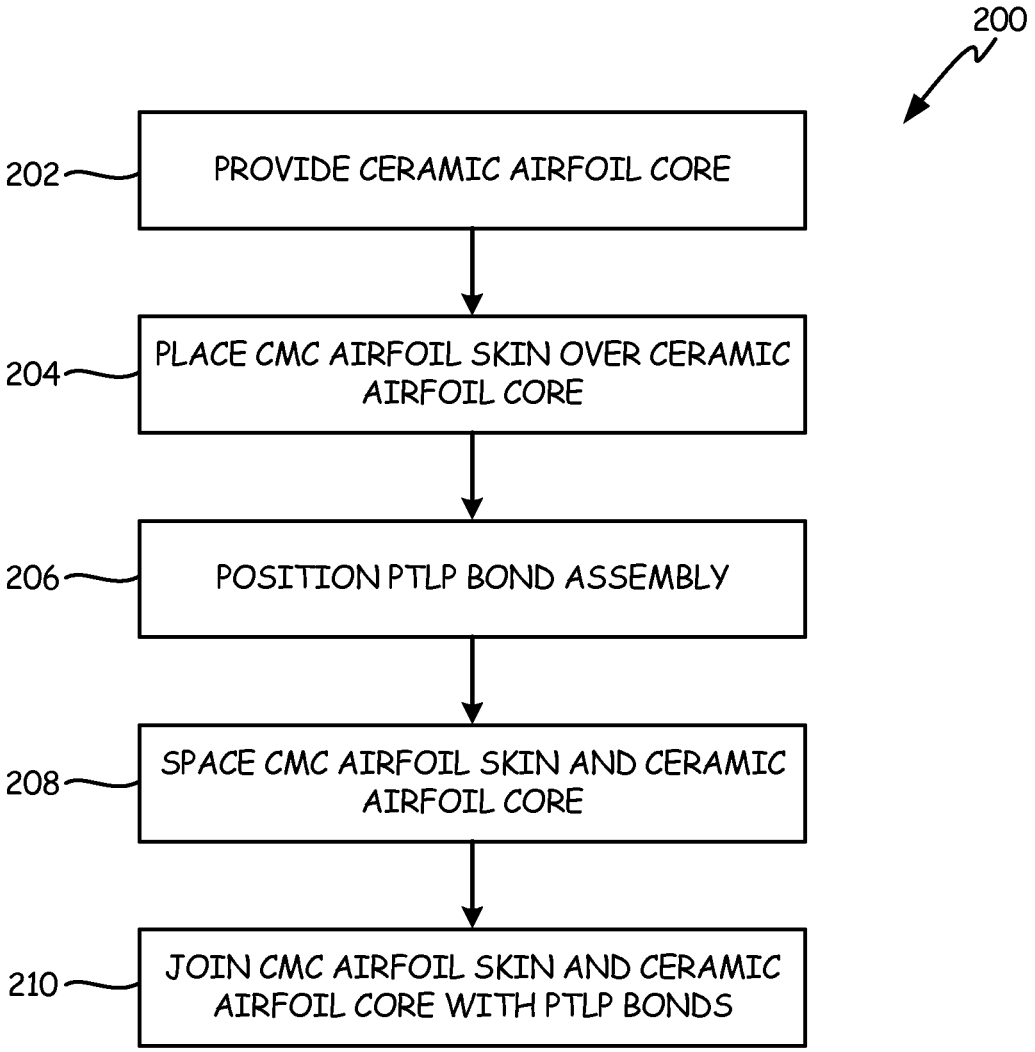
FIG. 6 shows steps of a method for making a hybrid ceramic/CMC airfoil.

FIG. 6 is a chart showing steps of method 200 for making a hybrid airfoiled component such as is shown in FIGS. 2-5.

Method 200 begins with step 202 of providing a ceramic airfoil core. This core may have a similar geometry as ceramic core 96 in the example above. However, other configurations are also possible, and is one benefit to the hybrid ceramic/CMC configuration. As noted in the preceding examples, the hybrid configuration allows for numerous complex shapes that would be too expensive or difficult to form out of a purely CMC airfoil. It also permits portions of the ceramic core to form leading and/or trailing edges of the airfoil to further simplify formation of the blade.

The ceramic airfoil core can be cast or otherwise formed out of a ceramic compound selected from one of: aluminum oxide ($Al_2O_3$), silicon nitride ($Si_3N_4$), silicon carbide (SiC), tungsten carbide (WC), and zirconium oxide ($ZrO_2$).

Step 204 includes placing a ceramic matrix composite (CMC) airfoil skin over at least a portion of the ceramic airfoil core. This can include placing one or more sheets of CMC material over the ceramic core such that they form an airfoil surface. The CMC skin can include a plurality of fibers selected from one or more of: silicon carbide (SiC), titanium carbide (TiC), aluminum oxide ($Al_2O_3$), and carbon (C); and a ceramic matrix selected from one or more of: aluminum oxide ($Al_2O_3$), silicon nitride ($Si_3N_4$), and silicon carbide (SiC).

Step 206 can include, for example, placing a first thin metallic layer adjacent a core-side bonding surface, placing a second thin metallic layer on a skin-side bonding surface, and/or placing a refractory segment between the first and second thin metallic layers to form a bond assembly. Depending on the configuration of the desired airfoil, step 204 can be performed, in total or in part, after one or more of steps 206, 208, and 210. At least some of the constituents of the TLP and/or PTLP bond assembly can be positioned so as to prepare for steps 204, 208, and/or 210.

Optional step 208 involves spacing at least a portion of the CMC skin from the ceramic airfoil core. This can be done, for example, by providing a plurality of thermal protection structures between an outer surface of the ceramic airfoil core and an inner surface of the CMC airfoil skin. Each thermal protection structure can be provided a core side and a skin side joined to a corresponding one of the inner surface of the CMC airfoil skin and the outer surface of the ceramic airfoil core. Alternatively, the plurality of thermal protection structures can be integral with at least one of the inner surface of CMC airfoil skin and the outer surface of the ceramic airfoil core.

And at step 210, the CMC skin is joined to the ceramic core to define an airfoil shape. As shown in FIGS. 4A-5B, the CMC skin can be joined to the core at least in part by forming at least one of a transient liquid phase (TLP) and a partial transient liquid phase (PTLP) bond between the ceramic core and the CMC skin. The bond assembly is then heated to a bonding temperature to form the at least one bond which has an alloyed interlayer with a melting temperature higher than the bonding temperature.

As was shown in FIG. 5B, the plurality of thermal protection structures can include at least one pair of opposed thermal protection elements, each of which includes a first structure projecting from the inner surface of the CMC airfoil skin, and a second structure projecting from the outer surface of the ceramic airfoil core. In these embodiments, joining step 206 can therefore include forming at least one partial transient liquid phase (PTLP) bond between each of the plurality of thermal protection structures and at least one of the ceramic airfoil core and the CMC airfoil skin.

DISCUSSION OF POSSIBLE EMBODIMENTS

The following are non-exclusive descriptions of possible embodiments of the present invention.

An airfoil comprises a core having a first surface, a skin having a second surface disposed over at least a portion of the first surface of the core, and at least one of a transient liquid phase (TLP) bond and a partial transient liquid phase (PTLP) bond. The at least one bond is disposed between the first surface and the second surface, joining the skin to the core.

The airfoil of the preceding paragraph can optionally include, additionally and/or alternatively, any one or more of the following features, configurations and/or additional components:

An airfoil according to an exemplary embodiment of this disclosure, among other possible things includes a core having a first surface; a skin having a second surface disposed over at least a portion of the first surface of the core; and at least one of a transient liquid phase (TLP) bond and a partial transient liquid phase (PTLP) bond disposed between the first surface and the second surface, the bond joining the skin to the core.

A further embodiment of the foregoing airfoil, wherein the core comprises a ceramic compound selected from the group consisting of: aluminum oxide ($Al_2O_3$), silicon nitride ($Si_3N_4$), silicon carbide (SiC), tungsten carbide (WC), and zirconium oxide ($ZrO_2$). A further embodiment of any of the foregoing airfoils, wherein the core is monolithic.

A further embodiment of any of the foregoing airfoils, wherein the core defines at least one of: a leading edge of the airfoil, and a trailing edge of the airfoil.

A further embodiment of any of the foregoing airfoils, wherein the skin comprises at least one ceramic matrix composite (CMC) material.

A further embodiment of any of the foregoing airfoils, wherein the at least one CMC material comprises a plurality of ceramic fibers selected from one or more of: silicon carbide (SiC), titanium carbide (TiC), aluminum oxide ($Al_2O_3$), and carbon (C).

A further embodiment of any of the foregoing airfoils, wherein the at least one CMC material comprises a ceramic matrix selected from one or more of: aluminum oxide ($Al_2O_3$), silicon nitride ($Si_3N_4$), and silicon carbide (SiC).

A further embodiment of any of the foregoing airfoils, wherein the skin is generally spaced from the core except proximate a location of the at least one bond.

A further embodiment of any of the foregoing airfoils, wherein the skin is generally spaced from the core by a plurality of thermal protection structures disposed therebetween, the plurality of thermal protection structures each having a core side and a skin side joined to corresponding one of the skin inner surface and the core outer surface.

A further embodiment of any of the foregoing airfoils, wherein at least one of the core side and the skin side is joined to the corresponding one of the CMC skin and the ceramic core by the at least one bond.

A further embodiment of any of the foregoing airfoils, wherein the at least one bond includes a PTLP bond comprising an alloyed interlayer having a melting temperature higher than a melting temperature of at least one constituent element defining the alloyed interlayer.

A further embodiment of any of the foregoing airfoils, wherein the skin includes at least one of a pressure-side sheet and a suction-side sheet.

A further embodiment of any of the foregoing airfoils, wherein the skin extends over the core proximate to at least one of a leading-edge portion of the core and a trailing-edge portion of the core.

A method for making a hybrid airfoiled component comprises providing a ceramic airfoil core. A ceramic matrix composite (CMC) airfoil skin is placed over at least a portion of the ceramic airfoil core. The CMC skin is joined to the ceramic core to define an airfoil shape. The joining step is performed at least in part by forming a partial transient liquid phase (PTLP) bond between the ceramic core and the CMC skin.

The method of the preceding paragraph can optionally include, additionally and/or alternatively, any one or more of the following features, configurations and/or additional components:

A method for making a hybrid airfoil according to an exemplary embodiment of this disclosure, among other possible things includes: providing a ceramic airfoil core; placing a ceramic matrix composite (CMC) airfoil skin over at least a portion of the ceramic airfoil core; positioning at least one constituent element of a partial transient liquid phase (PTLP) bond assembly between the CMC skin to the ceramic core; and joining the CMC skin to the ceramic airfoil core, the joining step performed at least in part by forming a PTLP bond between the ceramic core and the CMC skin.

A further embodiment of the foregoing method, wherein the ceramic airfoil core comprises a ceramic compound selected from the group consisting of: aluminum oxide ($Al_2O_3$), silicon nitride ($Si_3N_4$), silicon carbide (SiC), tungsten carbide (WC), and zirconium oxide ($ZrO_2$).

A further embodiment of any of the foregoing methods, wherein the CMC skin comprises a plurality of fibers selected from the group consisting of: silicon carbide (SiC), titanium carbide (TiC), aluminum oxide ($Al_2O_3$), and carbon (C); and a ceramic matrix selected from the group consisting of: aluminum oxide ($Al_2O_3$), silicon nitride ($Si_3N_4$), and silicon carbide (SiC).

A further embodiment of any of the foregoing methods, further comprising: spacing at least a portion of the CMC skin from the ceramic airfoil core.

A further embodiment of any of the foregoing methods, wherein spacing at least a portion of the CMC skin comprises: providing a plurality of thermal protection structures between an outer surface of the ceramic airfoil core and an inner surface of the CMC airfoil skin, the plurality of thermal protection structures each having a core side and a skin side joined to a corresponding one of the inner surface of the CMC airfoil skin and the outer surface of the ceramic airfoil core.

A further embodiment of any of the foregoing methods, wherein the plurality of thermal protection structures are integral with at least one of the inner surface of CMC airfoil skin and the outer surface of the ceramic airfoil core.

A further embodiment of any of the foregoing methods, wherein the plurality of thermal protection structures comprises at least one pair of opposed thermal protection structures, the pair of opposed thermal protection structures including a first structure projecting from the inner surface of the CMC airfoil skin, and a second structure projecting from the outer surface of the ceramic airfoil core.

A further embodiment of any of the foregoing methods, wherein the joining step comprises: forming at least one partial transient liquid phase (PTLP) bond between each of the plurality of thermal protection structures and at least one of: the ceramic airfoil core and the CMC airfoil skin.

A further embodiment of any of the foregoing methods, wherein the at least one constituent element of the PTLP bond assembly is selected from the group consisting of: placing a first thin metallic layer adjacent a core side bonding surface; placing a second thin metallic layer on a skin side bonding surface; and placing a refractory bond core between the first and second thin metallic layers to form a bond assembly.

A further embodiment of any of the foregoing methods, wherein the joining step comprises: heating the bond assembly to a bonding temperature to form the at least one PTLP bond, the at least one PTLP bond including an alloyed interlayer having a melting temperature higher than the bonding temperature.

A further embodiment of any of the foregoing methods, wherein the CMC skin defines at least a suction sidewall and a pressure sidewall of the airfoil shape.

A further embodiment of any of the foregoing methods, wherein the ceramic core defines at least one of: a leading edge of the airfoil, and a trailing edge of the airfoil.

Although the present invention has been described with reference to preferred embodiments, workers skilled in the art will recognize that changes may be made in form and detail without departing from the spirit and scope of the invention.

The invention claimed is:

1. An airfoil comprising:

a ceramic core having a first surface;

a skin having a second surface disposed over at least a portion of the first surface of the core, the skin comprising at least one ceramic matrix composite (CMC) material; and a plurality of bonds selected from one or both of a transient liquid phase (TLP) bond and a partial transient liquid phase (PTLP) bond disposed between the first surface and the second surface, the plurality of bonds joining the skin to the ceramic core;

wherein the skin is spaced from the ceramic core by the plurality of bonds, defining a thermal protection space between the skin and the ceramic core.

2. The airfoil of claim 1, wherein the ceramic core comprises a ceramic compound selected from the group consisting of: aluminum oxide ($Al_2O_3$), silicon nitride ($Si_3N_4$), silicon carbide (SiC), tungsten carbide (WC), zirconium oxide ($ZrO_2$), and combinations thereof.

3. The airfoil of claim 1, wherein the ceramic core is monolithic.

4. The airfoil of claim 1, wherein the skin extends over only a portion of the ceramic core such that the first surface of the ceramic core defines at least one of: a leading edge of the airfoil, and a trailing edge of the airfoil.

5. The airfoil of claim 1, wherein the at least one CMC material comprises a plurality of ceramic fibers selected from one or more of: silicon carbide (SiC), titanium carbide (TiC), aluminum oxide ($Al_2O_3$), carbon (C), and combinations thereof.

6. The airfoil of claim 1, wherein the at least one CMC material comprises a ceramic matrix selected from one or more of: aluminum oxide ($Al_2O_3$), silicon nitride ($Si_3N_4$), silicon carbide (SiC), and combinations thereof.

7. The airfoil of claim 1, wherein the skin includes at least one of a pressure-side sheet and a suction-side sheet.

8. The airfoil of claim 1, wherein the skin extends over the ceramic core proximate to at least one of a leading-edge portion of the core and a trailing-edge portion of the ceramic core.

9. The airfoil of claim 1, further comprising a plurality of thermal protection structures disposed, between the ceramic core and the skin, the plurality of thermal protection structures each having a core side and a skin side joined to corresponding one of the skin inner surface and the core outer surface.

10. The airfoil of claim 9, wherein at least one of the core side and the skin side is joined to the corresponding one of the skin and the ceramic core by at least one of the plurality of bonds.

11. The airfoil of claim 10, wherein the at least one of the plurality of bonds includes a PTLP bond comprising an alloyed interlayer having a melting temperature higher than a melting temperature of at least one constituent element defining the alloyed interlayer.

12. A method for making a hybrid airfoil, the method comprising:

providing a ceramic airfoil core;

placing a ceramic matrix composite (CMC) airfoil skin over at least a portion of the ceramic airfoil core;

spacing at least a portion of the CMC skin from the ceramic airfoil core;

positioning at least one constituent element of a partial transient liquid phase (PTLP) bond assembly between the CMC skin to the ceramic core; and joining the CMC skin to the ceramic airfoil core, the joining step performed at least in part by heating the at least one constituent element of the partial transient liquid phase (PTLP) bond assembly, thereby forming a PTLP bond between the ceramic core and the CMC skin;

wherein the portion of the CMC skin is spaced from the ceramic airfoil core except proximate the PTLP bond, defining a thermal protection space between the CMC skin and the ceramic core.

13. The method of claim 12, wherein the ceramic airfoil core comprises a ceramic compound selected from the group consisting of: aluminum oxide ($Al_2O_3$), silicon nitride ($Si_3N_4$), silicon carbide (SiC), tungsten carbide (WC), zirconium oxide ($ZrO_2$), and combinations thereof.

14. The method of claim 12, wherein the CMC skin comprises:

a plurality of fibers selected from the group consisting of: silicon carbide (SiC), titanium carbide (TiC), aluminum oxide ($Al_2O_3$), carbon (C), and combinations thereof; and a ceramic matrix selected from the group consisting of: aluminum oxide ($Al_2O_3$), silicon nitride ($Si_3N_4$), silicon carbide (SiC), and combinations thereof.

15. The method of claim 12, wherein positioning the at least one constituent element of the PTLP bond assembly is selected from the group consisting of:

placing a first thin metallic layer adjacent a core side bonding surface;

placing a second thin metallic layer on a skin side bonding surface; and placing a refractory bond core between the first and second thin metallic layers to form a bond assembly.

16. The method of claim 12, wherein the joining step comprises:

heating the PTLP bond assembly to a bonding temperature to form the at least one PTLP bond, the at least one PTLP bond including an alloyed interlayer having a melting temperature higher than the bonding temperature.

17. The method of claim 12, wherein the CMC skin defines at least a suction sidewall and a pressure sidewall of the airfoil shape.

18. The method of claim 17, wherein the ceramic core defines at least one of: a leading edge of the airfoil, and a trailing edge of the airfoil.

19. The method of claim 12, wherein spacing at least a portion of the CMC skin comprises:

providing a plurality of thermal protection structures between an outer surface of the ceramic airfoil core and an inner surface of the CMC airfoil skin, the plurality of thermal protection structures each having a core side and a skin side joined to a corresponding one of the inner surface of the CMC airfoil skin and the outer surface of the ceramic airfoil core.

20. The method of claim 19, wherein the plurality of thermal protection structures are integral with at least one of the inner surface of CMC airfoil skin and the outer surface of the ceramic airfoil core.

21. The method of claim 19, wherein the plurality of thermal protection structures comprises at least one pair of opposed thermal protection structures, the pair of opposed thermal protection structures including a first structure projecting from the inner surface of the CMC airfoil skin, and a second structure projecting from the outer surface of the ceramic airfoil core.

22. The method of claim 19, wherein the joining step comprises:

forming at least one partial transient liquid phase (PTLP) bond between each of the plurality of thermal protection structures and at least one of: the ceramic airfoil core and the CMC airfoil skin.

* * * * *